US008517117B2

(12) United States Patent
Mikulec

(10) Patent No.: US 8,517,117 B2
(45) Date of Patent: Aug. 27, 2013

(54) RANGE HOOD FIRE SUPPRESSION SYSTEM WITH VISIBLE STATUS INDICATION

(71) Applicant: Conrad S. Mikulec, Buffalo, NY (US)

(72) Inventor: Conrad S. Mikulec, Buffalo, NY (US)

( * ) Notice: Subject to any disclaimer, the term of this patent is extended or adjusted under 35 U.S.C. 154(b) by 0 days.

(21) Appl. No.: 13/652,435

(22) Filed: Oct. 15, 2012

(65) Prior Publication Data

US 2013/0092404 A1 Apr. 18, 2013

Related U.S. Application Data

(60) Provisional application No. 61/546,576, filed on Oct. 13, 2011.

(51) Int. Cl.

| | |
|---|---|
| ***A62C 3/00*** | (2006.01) |
| ***A62C 37/10*** | (2006.01) |
| ***A62C 37/00*** | (2006.01) |
| ***A62C 11/00*** | (2006.01) |

(52) U.S. Cl.

USPC ..... 169/65; 169/33; 169/56; 169/60

(58) Field of Classification Search

USPC ..... 169/30, 33, 56, 57, 58, 59, 60, 65

See application file for complete search history.

(56) References Cited

U.S. PATENT DOCUMENTS

| | | | | |
|---|---|---|---|---|
| 3,653,443 | A * | 4/1972 | Dockery | 169/61 |
| 3,824,374 | A * | 7/1974 | Mayher | 219/510 |
| 4,756,839 | A | 7/1988 | Curzon et al. | |
| 4,813,487 | A * | 3/1989 | Mikulec et al. | 169/65 |
| 4,979,572 | A * | 12/1990 | Mikulec | 169/65 |
| 5,992,531 | A | 11/1999 | Mikulec | |
| 7,303,024 | B2 | 12/2007 | Mikulec | |
| 2005/0039930 | A1 * | 2/2005 | Gwak | 169/30 |

* cited by examiner

*Primary Examiner* — Len Tran
*Assistant Examiner* — Justin Jonaitis
(74) *Attorney, Agent, or Firm* — Lakeview Patents LLC

(57) ABSTRACT

A fire suppression system with a visible status indicator positioned within a ventilation hood of a stove is described. The fire suppression system comprises a container within which resides a fire suppressing material and an expulsion activation mechanism subassembly. The fire suppressing material further comprises a dye colorant material. The system further comprising a light source positioned adjacent and projected through the container such that when the fire suppressant material is present within the container, the light appears to be a different color. The system positioned with a canopy portion of a ventilation hood.

50 Claims, 14 Drawing Sheets

RANGE HOOD FIRE SUPPRESSION SYSTEM WITH VISIBLE STATUS INDICATION

CROSS-REFERENCE TO RELATED APPLICATION

The present application claims priority from U.S. Provisional Application Ser. No. 61/546,576 filed Oct. 13, 2011.

BACKGROUND OF THE INVENTION

1. Field of the Invention

The present invention relates to fire suppression apparatuses, assemblies and systems, more specifically, to a fire suppression system for stoves, ovens, and other cooking appliances.

2. Prior Art

The use of automatically activated fire extinguishing devices for cooking stoves and the like is known. Such devices generally provide a source of fire extinguishing compound to be released on to a stove surface in the event of a fire, which occurs during use of the appliance. The spraying device is normally located above the cooking surface, and the fire extinguishing compound is conveyed from the container, through the piping and out through the spraying device to put out the fire.

Prior art fire extinguishing devices however are relatively bulky. In one such prior art device, the fire-extinguishing compound is generally stored in a container at a location remote from the stove with a piping arrangement connecting the container with a spraying device for dispensing the compound onto the stove. Other prior art systems utilize a fire extinguisher that is incorporated with the system. These systems also tend to be bulky and require a significant amount of space for their operation as they require additional space for the fire extinguisher cylinder in addition to the activation subassembly and associated tubing. Furthermore, these prior art systems require periodic maintenance and may require the replacement of the fire extinguishing material over a relatively short period of time due in part to the increased pressure under which the extinguishing material is stored within the container.

Prior art automatic fire-extinguishing devices also may include an automatic shut-off arrangement for shutting off either the electricity or gas to a stove (depending on the stove type) upon detection of a fire. Known shut-off arrangements are generally complex and can only be installed by an electrician or other professional, thus they also contribute to on-site installation time and expense.

In the integration of a fire suppression system into a confining space, such as a range ventilation hood, it is desirable to have a fire extinguishing system designed with a streamlined and compact design comprising a relatively few number of components. In addition, it is desirable to conceal such systems and their associated components. This is done for aesthetic reasons in addition to the practical reason of being able to position the system in a multitude of confining spaces within the food preparation area such that the system components do not interfere with cooking operations. Accordingly, the system is typically installed beneath a downwardly extending canopy that forms a portion of the hood.

Fire suppression systems of the prior art, particularly those that utilize a fire extinguisher, may include a gauge that indicates that the containment cylinder of the fire extinguisher is full and ready for service in the event of a fire. However, this gauge is typically mounted directly on the cylinder, and thus also concealed as a consequence of concealing the overall system. Any alternative system status sensors and indicators are also likely to be concealed.

For a user of the range with such a prior art fire suppression system, it requires an affirmative act to check the status of the system, such as by leaning over the range burners, and looking upwardly at the system concealed under the canopy to see the gauge or other indicator. Such an affirmative act to check the status of the extinguisher may not be possible because of the concealed location of the indicator. In addition, this affirmative act of checking the status of the extinguisher may not be possible by a user of the stove who is disabled or has a physical limitation. Furthermore, these prior art gauges are not always accurate. Many times these gauges may become stuck or malfunction and thus, may, incorrectly display that the fire extinguisher is full or operating correctly.

Because the fire suppression system is a critical safety system that can save lives and property, this should be done frequently. However, in day-to-day use of the range, users often become complacent, and are not diligent in performing regular system checks. Circumstances could arise where the fire extinguisher is emptied, such as by one user causing a first fire, and the extinguisher being discharged. After cleanup of the range with no knowledge of the fire extinguisher being spent, due to the lack of a clear visible indication of the fire extinguisher discharge. The fire suppression system would be in a state of non-readiness, and it would fail to extinguish a second fire, if one occurred during operation by the second user. But for the provision of a clear and easily viewed status indicator that warned the second user of the state of the non-readiness of the extinguisher, this second fire and dire consequences could have been avoided. Since the fire suppressant material of prior art fire suppression systems resides within an opaque container, a direct affirmative check as to whether the fire suppressant material is actually present in the system is not possible.

Therefore, there is a need in the art for a fire extinguishing device which is unobtrusive in appearance, is relatively lightweight, compact, and does not require a prohibitive amount of on-site installation time, maintenance and expense. In addition, there is also a need for an automatic shut-off arrangement for disconnecting the power and/or fuel source of the stove, which is simple in design and does not require expert assistance for installation. Furthermore, there is a need for a fire suppression system having a status indicator that is clearly visible and completely reliable, so that before using the stove, a user knows that the fire suppression system is ready and operational. Thus, the present invention addresses these shortcomings and provides a compact and reliable fire suppression system having a clearly visible and reliable status indicator.

SUMMARY OF THE INVENTION

The present invention provides a fire suppression system having a clear visible indication of its status. In addition, the fire suppression system of the present invention has a compact structure that is designed to be positioned within a confined area of a food preparation area. Specifically, the fire suppression system is designed to be positioned within a ventilation hood of a stove. More specifically, the system may be positioned within a canopy portion of the ventilation hood of a stove. The fire suppression system of the present invention comprises a container, within which resides, a fire suppressant material an expulsion actuator subassembly, and a valve mechanism. The container, at least a portion of which, comprises a sidewall or opening that is translucent to visible light. The container is preferably mounted adjacent to a light source. In addition, the fire suppression system may comprise a housing, which surrounds at least a portion of the container and associated system components.

The actuator subassembly comprises a ram, a spring, a connection rod, a trigger member, and a fuse member. When activated, the actuator subassembly provides a force that expels the fire suppressant material out of the container. The activation subassembly, a portion of which resides within the container, has a compact design that quickly expels the fire suppressant material onto a stovetop in the event of a fire.

The fire suppressant material composition comprises a fire retardant composition and a colorant that resides within the container. The light source is positioned such that light is directed through the light translucent portion of the sidewall of the container. More specifically, the light source may be positioned such that visible light is able to be transmitted through a first sidewall portion of the container, through the fire suppressant composition and through a second visible light translucent portion, positioned in an opposing orientation from the first sidewall portion. Alternatively, a housing comprising a light translucent window may be positioned, at least partially around the container. In addition, a ventilation hood light translucent window may be positioned within the thickness of a canopy portion of the ventilation hood of a stove.

The system is designed such that when visible light is transmitted through the container, the colorant within the fire suppressant composition alters the appearance of the light. When the fire suppressant composition is present in the container, the visible light emitted therethrough is of a first appearance and the visible light is of a second appearance when the fire suppressant composition has been depleted or expelled from the container.

In addition, the system of the present invention comprises an oven/stove shutoff mechanism. The oven/stove shutoff mechanism is designed to automatically shut off the flow of electricity and/or natural gas to a stove or oven in the event of a fire. The shut off mechanism may be activated by the system utilizing a wired or wireless means. In a preferred embodiment, the system utilizes the X10 communication protocol to activate the shutoff mechanism.

Furthermore, the system of the present invention provides a quick and easy means of installation that does not require additional electrical lines or gas lines to be run in the dwelling. The system of the present invention is designed for modular installation that can be installed in existing ventilation hood spaces. The wireless and X10 communication protocol oven/stove shutoff capabilities of the system, enable the system to be installed utilizing existing electrical and gas line connections.

DETAILED DESCRIPTION OF THE PREFERRED EMBODIMENTS

Figure 1:
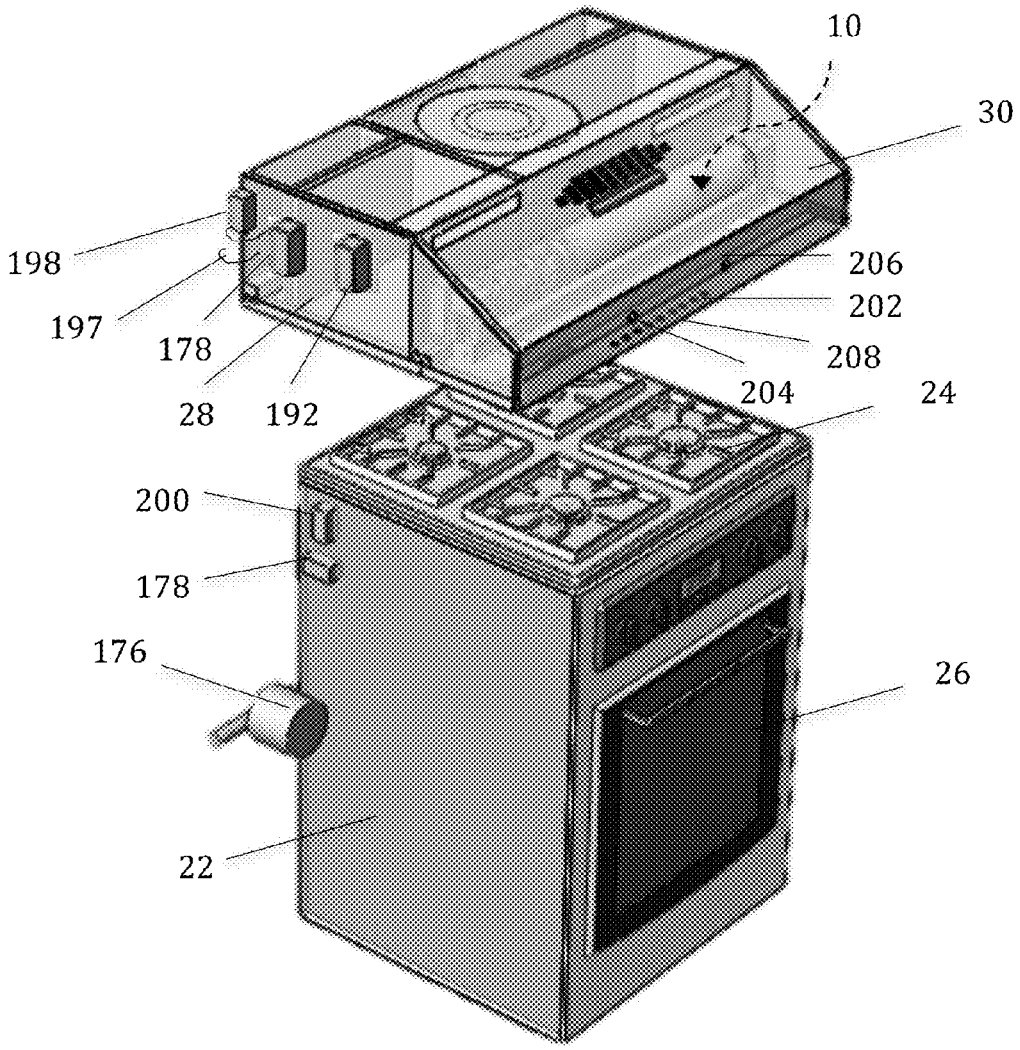
FIG. 1 illustrates a perspective view of an embodiment of the fire suppression system of the present invention positioned within a canopy portion of a ventilation hood over a stove.
Figure 2:
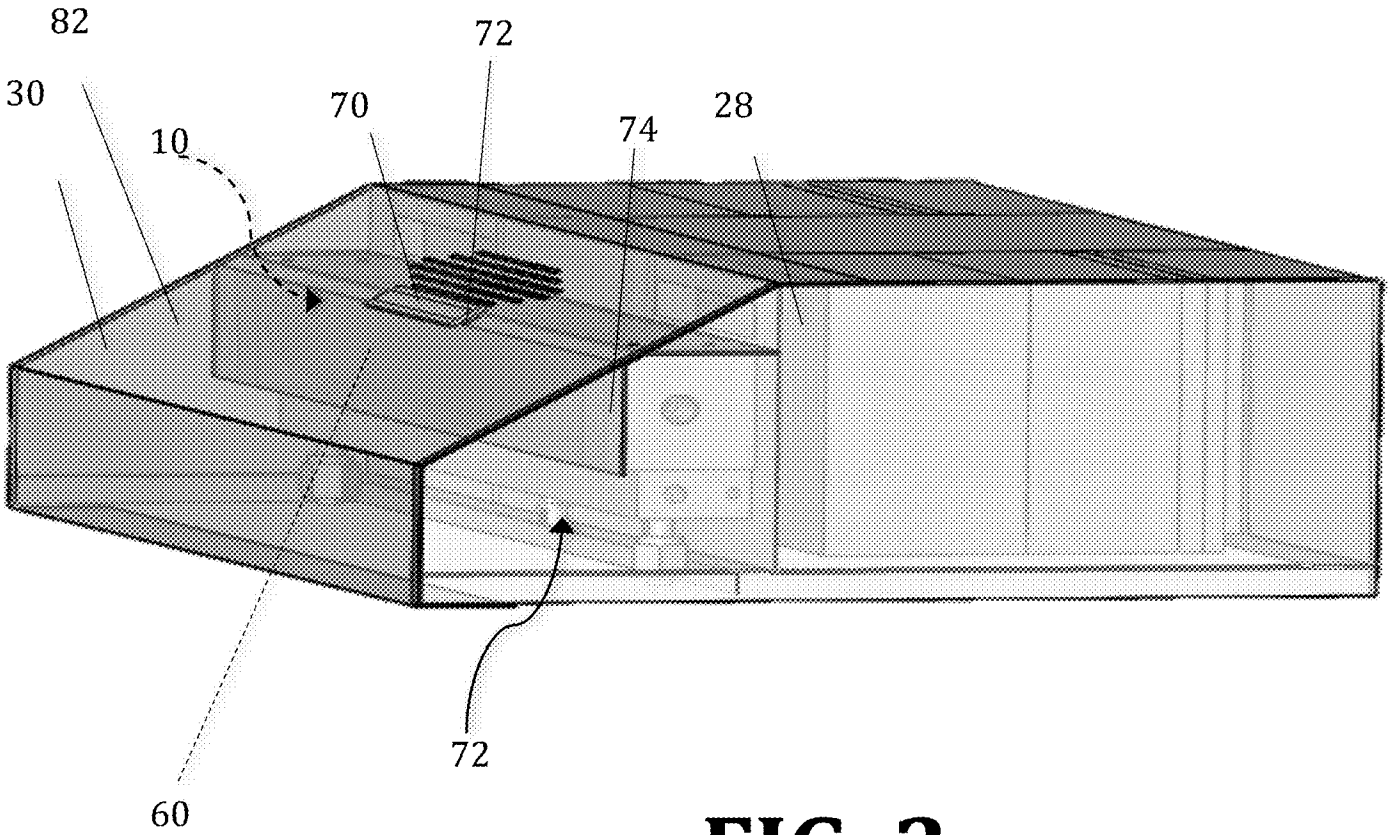
FIG. 2 shows a perspective view of an embodiment of the fire suppression system positioned within a canopy portion of a ventilation hood.

Now referring to the figures, FIGS. 1-3, 3A, 4-5, and 9-12 illustrate embodiments of a fire suppression system 10 of the present invention. The fire suppression system 10 comprises a container 12, a fire suppressant composition 14 contained therewithin, a light source 16, a valve mechanism 18, and an actuator subassembly 20. In a preferred embodiment, the fire suppression system 10 is designed to fit within a confined space over a cooking appliance such as a stove 22 comprising a series of burners 24 and an oven portion 26. In a preferred embodiment, the fire suppression system 10 of the present invention is positioned within a ventilation hood 28, more preferably, a canopy portion 30 of the ventilation hood 28 of a stove 22. Although it is preferred to position the system 10 within the canopy portion 30 of the ventilation hood 28, the system 10 may be positioned within an overhang portion or positioned within, or affixed to, a ceiling 32 such that it is positioned above a stove 22 or an appliance that emits heat.

The term "stove" is herein defined as a portable or fixed apparatus that burns fuel, such as a gas or flammable liquid, or uses electricity to provide heat for the purpose of cooking or heating. The term "oven" is herein defined as a chamber that is heated through the burning of a fuel, such as a gas or flammable liquid, or uses electricity to provide heat for the purpose of cooking or heating. The term "range" is herein defined as a portable or fixed apparatus that burns fuel or uses electricity to provide heat for the purpose of cooking or heating. A "range" may comprise a multitude of burners and/or one or more ovens. The term "plenum" is herein defined as the primary space within the main body of a ventilation hood of a stove or oven. The plenum portion of the ventilation hood typically resides at the rear of the ventilation hood. The term "canopy" is herein defined as the secondary space within the ventilation hood. The plenum portion typically has an area and volume that is greater than the canopy portion. The canopy portion is typically positioned at the front of the ventilation hood however, the canopy portion may be positioned within an outer diameter portion of the ventilation hood.

As illustrated in FIGS. 3, 3A, 4, 7, and 7A, the container 12 comprises a distal container portion 34 spaced from a proximal container portion 36 an annular container sidewall 38 extending therebetween. The container 12 is preferably of a tubular form. In a preferred embodiment, the container 12 has an elongated container length 40 that extends from about 3 inches to about 50 inches. In a preferred embodiment, the container 12 is positioned lengthwise within the canopy portion 30 of the ventilation hood 28. However, the container 12 may be positioned such that it lies at an askew angle with respect to longitudinal axis A-A. Alternatively, the container 12 may be positioned at an angle that is about perpendicular with respect to longitudinal axis A-A and extends through the canopy portion 30 of the ventilation hood 28.

The container 12 preferably has a curved cross-section, more preferably a circular cross-section. The container 12 may have an outer diameter ranging from about 1 inch to about 5 inches. Alternatively, the cross-sectional shape of the container 12 may comprise a multitude of non-limiting polygon shapes including but not limited to, a rectangle, a square, an oval, a triangle, a hexagon, or the like.

Figure 3:
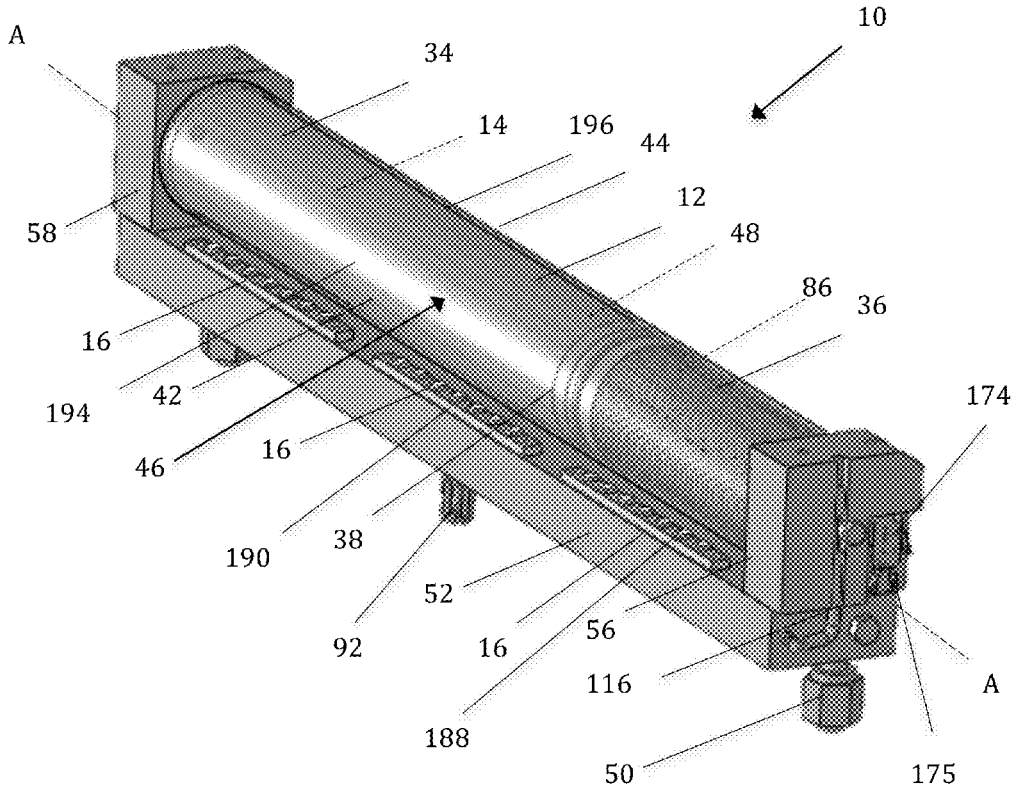
FIG. 3 is a perspective view of a preferred embodiment of the fire suppression assembly of the present invention.
Figure 3A:
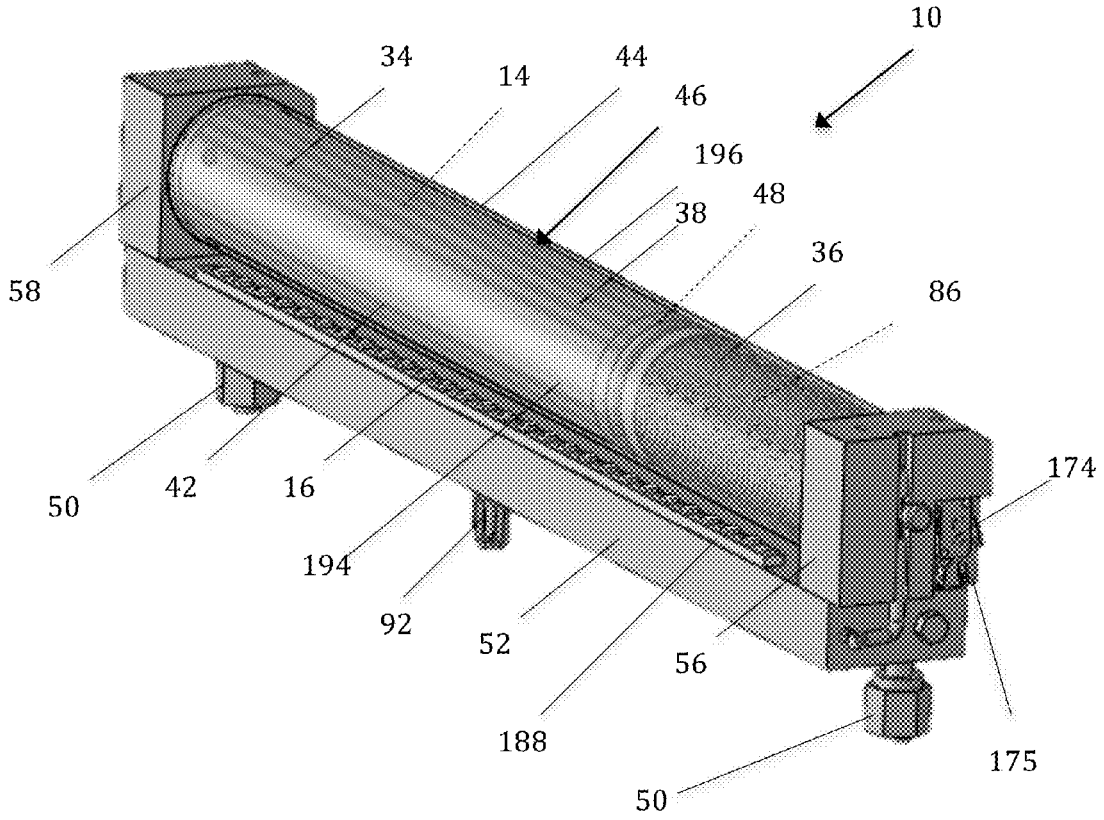
FIG. 3A illustrates a perspective view of an alternate embodiment of a fire suppression assembly of the present invention.

In a preferred embodiment, at least a portion of the container sidewall 38 is translucent or transparent to light. This is constructed such that light, particularly visible light is transmittable through the width of the container 12 from a container left side 42 through a container right side 44 (FIGS. 3, 3A). Alternatively, the container 12 may be comprised of a light translucent material. In a preferred embodiment, the container 12 may be composed of a glass, such as a silicate or borosilicate glass, or a light translucent polymeric material, such as polycarbonate, a polymethyl methacrylate material, graphene or the like.

In an embodiment, an exterior surface 46 of the container 12 may also comprise a coating, which modifies the intensity, or color appearance of the visible light, which is transmitted therethrough. Such coatings may comprise a polymeric material such as polycarbonate, polymethyl methacrylate, graphene or combinations thereof. The annular container sidewall 38 defines a cavity 48 within the container 12 that extends longitudinally along the length 40 of the container 12.

As shown in FIGS. 4, 4A, 5, and 6, the fire suppressant composition 14 resides within the distal portion 34 of the container 12. The fire suppression actuator sub-assembly 20, at least partially, resides within the proximal portion 34 of the container 12. In a preferred embodiment, the fire suppressant composition 14 resides within the container 12 in a standard state condition. More specifically, the fire suppressant composition 14 resides within the container 12 such that that material 14 is not under pressure nor does the fire suppressant composition 14 undergo a chemical reaction while residing within the container 12.

In a preferred embodiment, the fire suppressant composition 14 resides within the container 12 under a standard state condition until the actuator sub-assembly 20 activates the system 10. This preferred standard state condition, significantly reduces the possibility of the fire suppressant composition 14 rupturing or leaking from the container 12, particularly over an extended period of time. It is not until the system 10 is activated, by movement of the actuator sub-assembly 20, that pressure is exerted on the fire suppressant composition 14 within the container 12. When activated, a hydrostatic pressure of less than about 45 pounds per square inch (PSI) is applied to the fire suppressant composition 14 which expels the fire suppressant composition 14 from the container 12. Since the fire suppressant material 14 is expelled under hydrostatic pressure, the system 10 may operate in a zero gravity environment, such as in outer space environments. Furthermore, the container 12 and fire suppressant material 14 of the system 10 are designed to meet or exceed the specifications of the American National Standards Institute (ANSI) Underwriters Laboratory (UL) specifications 299 and 300A which govern the construction, performance, packaging and transportation requirements of fire extinguishers and residential range top extinguisher units (GMCH).

Actuation of the fire suppression actuator sub-assembly 20 acts to discharge or expel the fire suppressant composition 14 from the container 12 in the event that a fire occurs. In addition, other components such as tubing, and at least one nozzle 50 may be used in concert with the actuator sub-assembly 20 in delivering the fire suppressant composition 14 to the fire.

Figure 4:
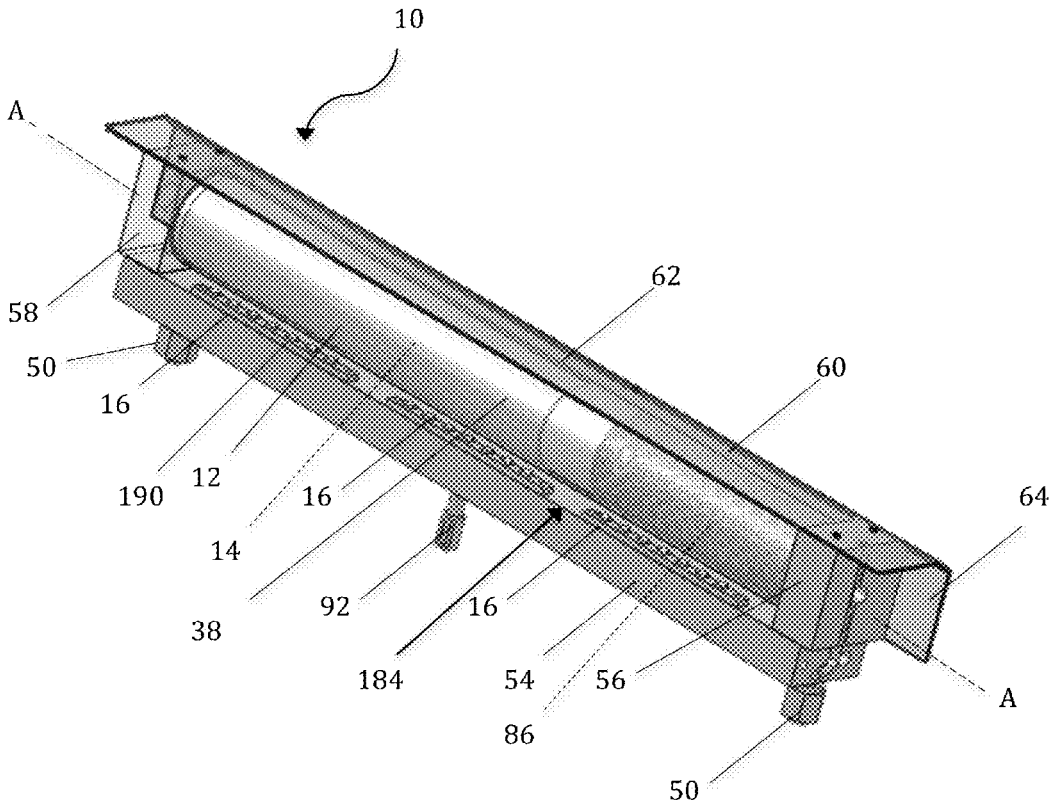
FIG. 4 shows an alternate embodiment of the fire suppression assembly comprising a housing.

As illustrated in FIGS. 3, 3A, and 4, the system 10 comprises various support members that provide mechanical stability and hold the components of the system together. In a preferred embodiment, a base support member 52 extends longitudinally along the length of the container 12. The base support member 52 provides mechanical support for the container 12 on which it resides. In addition, the base support member 52 conceals the bottom portion of the container 12 from view. As will be discussed later, a base support member channel 54 resides within the thickness of the support 52. The channel 54 provides a passageway for the fire suppressant material 14 to flow from the container 12 to the stove 20 below.

Extending perpendicularly from the ends of the base support member 52 are a proximal end support member 56 and a distal end support member 58 which reside at the respective proximal and distal ends 36, 34 of the container 12. In addition to providing mechanical support to the container 12 and the system 10, the proximal and distal end support members 56, 58 are designed to conceal the components of the actuator subassembly 20 and valve mechanism 18 from view. Furthermore, these support members 54, 56, 58 provide a compact design and structure such that the system 10 could be positioned in a variety of non-limiting space confining areas.

The fire suppression system 10 of the present invention may comprise a housing 60. The housing 60 may be positioned such that it surrounds at least a portion of the system 10. As shown, in FIGS. 2, 4 and 5, the housing comprises a top panel portion 62, a front side panel portion 64, and an intermediate panel portion 66 positioned therebetween. More specifically, the top panel portion 62 is positioned about perpendicular to the side panel portion 64. Both the top and front side panels 62, 64 have an elongated length that extends about longitudinal axis A-A within the canopy portion 30 of the ventilation hood 28 of the stove 22. In a preferred embodiment, the length of the front side panel 64 may range from about 5 inches to about 50 inches. In addition, the front side panel 64 of the housing 60 has a width ranging from about 1 inch to about 30 inches, and a depth ranging from about 1 inch to about 20 inches. Preferably, the front side panel 64, the top panel 62, and the intermediate panel 66 have an exterior surface 68 that is planar. Alternatively, these panels 62, 64, and 66 may be constructed with a sidewall having a curved cross-section. The curved cross-section of these panels 62, 64, and 66 is designed to help position the system 10 within the curved confines of the canopy portion 30 of the ventilation hood 28 of the stove 22. Alternately, these panels 62, 64, and 66 may comprise sidewalls having a cross-sectional shape of a multitude of polygons including but not limited to, a triangular, a square, a hexagon, a rectangle, or the like.

In a preferred embodiment, the intermediate panel 66 may comprise a window portion 70 that resides within the thickness of the sidewall 66. The window portion 70 is designed such that visible light may be transmitted therethrough. Alternatively, the front side panel 64 and/or the top panel 62 may also comprise the window portion 70 that resides within the thickness of the sidewall. This window portion is also designed such that visible light may be transmitted therethrough. Furthermore, it is contemplated that at least a portion of the sidewalls of the front side panel 64, the top panel 62 and/or the intermediate panel 66 be composed of a material through which light is transmittable therethrough. These panels 62, 64, and 66 may be made from a metallic, polymeric or ceramic material. Examples of which may include, but are not limited to, metallic materials such as stainless steel, aluminum, copper, titanium, a glass, such as a silicate or borosilicate glass, a polymeric material such as polypropylene, silicone rubber, polycarbonate or polymethyl methacrylate or combinations thereof.

Figure 5:
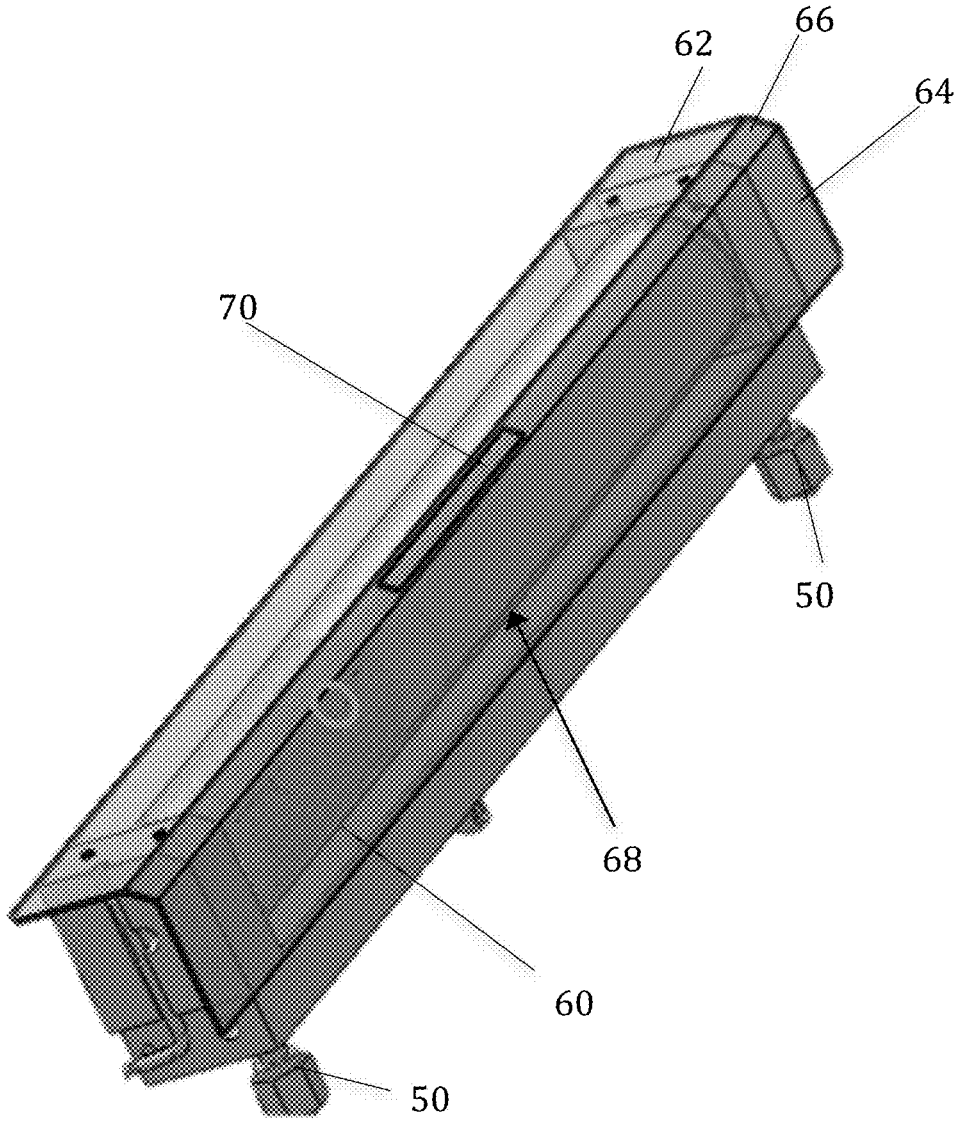
FIG. 5 shows a different perspective view of the fire suppression assembly shown in FIG. 4.

The window 70 may be positioned within the thickness of the sidewalls of at least one of the panels 62, 64, and 66 of the housing 60. In a preferred embodiment, as shown in FIG. 5, the window 70 resides within the thickness of the sidewall of the intermediate sidewall 66. Furthermore, the window 70 maybe positioned within an opening 72 of a sidewall 74 of the canopy portion 30 of the ventilation hood 28 as shown in FIGS. 1, 2, 12 and 13. In either case, the window portion 70 provides a portal through which visible light is transmitted.

In an alternate embodiment, the window 70 may reside within the sidewall of the panel portion 62, 64, and 66 such that its exterior surface protrudes outwardly and/or upwardly from the opening 72 of the exterior surface of the ventilation hood 28, particularly the canopy portion 30 of the ventilation hood 28. As shown in FIGS. 1 and 3, the window portion 70 is illustrated in an upward arcuate orientation. This is to provide increased visibility of the indicator of the fire suppression system 10. In a preferred embodiment, the window 70 may be designed such that it magnifies or focuses the transmitted light to a specific area distal of the ventilation hood 28 of the stove. The window 70 may also comprise a magnifying portion 76, which is positioned adjacent either the exterior or interior side of the window 70. The magnifying portion 76, which may comprise a magnifying layer of material or lens, is designed to intensify the transmitted light through the container 12. The window portion 70 comprises a light translucent material. Examples of which may include but are not limited to, a glass, such a borosilicate or a silicate glass, a light transmittable polymer, such as a polycarbonate, a polymethyl methacrylate material or the like.

In an embodiment, the panels 62, 64, and 66 may be positioned within a cutout portion 78 of the sidewall 74 of the canopy portion 30 of the ventilation hood 30 of the stove 22. A flange portion that extends from the sidewall of the front side panel 64, the intermediate panel 66 or the top panel 62, may be used to fastened and secure the system 10 within a canopy enclosure 82 with suitable fasteners (not shown).

Alternatively, the system 10 may be positioned within the canopy portion 30 through the use of a snap fit fastener. In addition, the front side panel 64 of the fire suppression system 10 of the present invention may be used as the front sidewall 74 of the canopy portion itself. In this case, the canopy portion 30 of the ventilation hood 28 of the stove or oven 22 lacks a front canopy sidewall 74. The front side panel 64 of the system 10 is therefore positioned such that it replaces the front canopy sidewall 74 that would otherwise be present.

Figure 6:
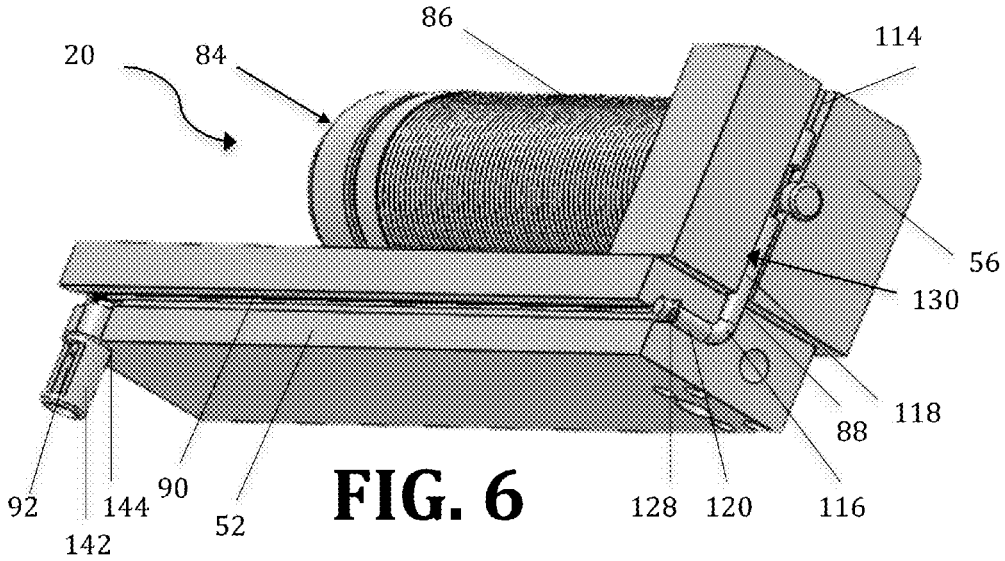
FIG. 6 illustrates an isolated perspective view of an embodiment of the actuation subassembly of the fire suppression system.
Figure 6A:
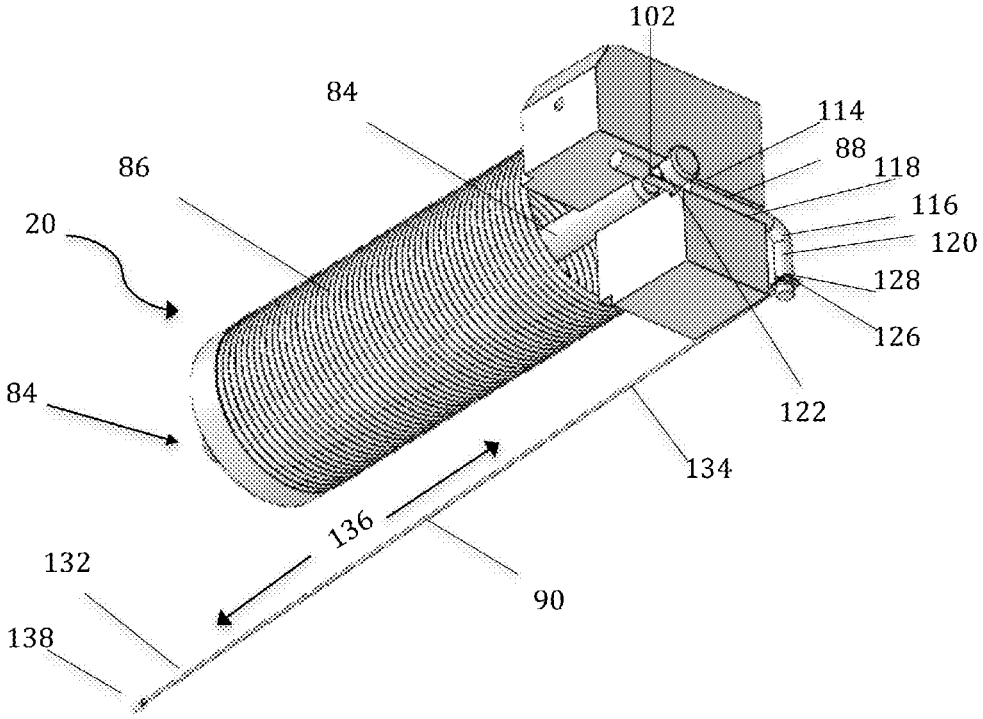
FIG. 6A illustrates an isolated perspective view of an alternate embodiment of the actuation subassembly of the fire suppression system.
Figure 7:
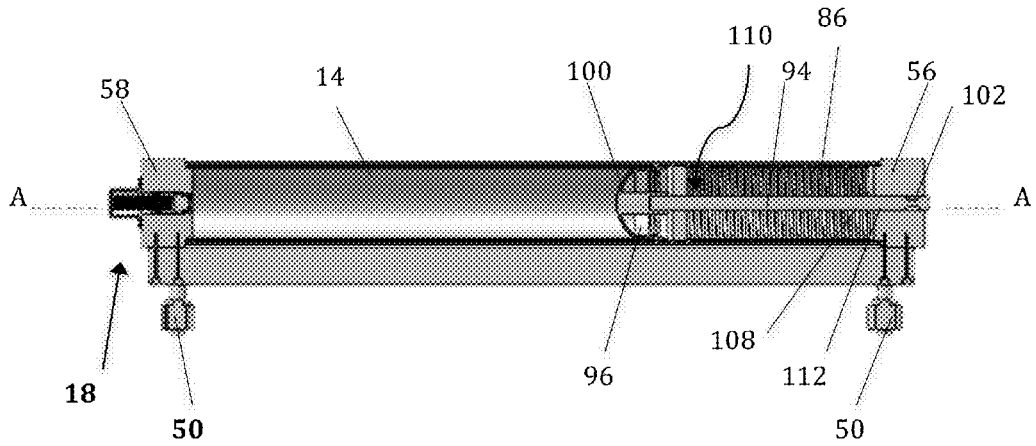
FIGS. 7 and 7A show cross-sectional views of the fire suppression assembly shown in FIG. 3 along longitudinal axis A-A.

As shown in FIGS. 6, 6A and 7, the actuator sub-assembly 20 of the fire suppressant system 10 of the present invention preferably comprises a mechanical mechanism that activates the system 10. As shown, the actuator sub-assembly 20 comprises a ram 84, a spring or bias member 86, a trigger member 88, a connection rod 90 and a fuse member 92. These components work in concert to expel the fire suppressant composition 14 in the event a fire is detected.

As shown, the ram 84 comprises an elongated ramrod 94 portion extending to a ram head 96 portion. The ram head 96 further comprises a ram head base wall 98 that extends to a ram head dome wall end 100. The ram head 96 is sized to have a radius, which is slightly less than the radius of the container 12, such that the ram head 96 fits snugly within the proximal end portion 36 of the container 12.

Figure 7A:
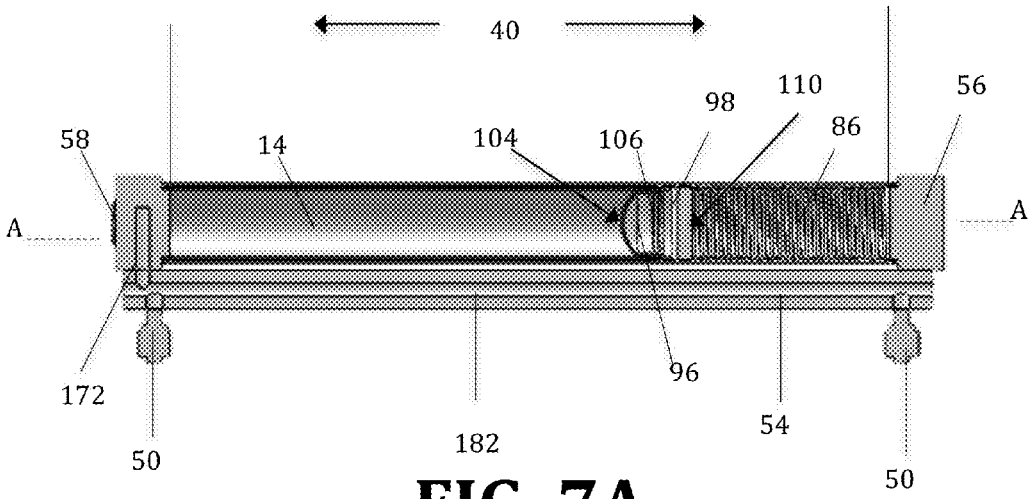

As shown in FIGS. 7 and 7A the ram 84 is positioned proximal of the fire suppressant composition 14 within the container 12. More specifically, a distal end surface 104 of the ram head 96 is positioned against the proximal end of the fire suppressant composition positioned within the container 12. The ramrod portion 94 extending proximally and longitudinally from a proximal end 106 of the ram head 96. In a preferred embodiment, a ramrod notch 102 extends through a portion of the diameter at a ramrod proximal end 108.

The ram head 96 should be formed of rubber or a resilient plastic such that it forms a seal around its outer surface with the internal wall of the container 12. However, the ram head 96 should be formed of a material which has a minimal coefficient of friction with the material that container 12 is formed of such that ram 84 movement within the container 12 is essentially uninhibited by the ram head's 96 contact within the container 12.

As shown, the bias member 86 is positioned proximal of the ram head 96. In a preferred embodiment the elongated bias member 86 is positioned circumferentially around the length of the ramrod 94 within the container 12. As shown in FIGS. 7 and 7A, the elongated ramrod 94 extends proximally and longitudinally from the ram head 96 portion through the central opening formed by the coils of the bias member 86. In its pre-activation state, the bias member 86 is compressed between the proximal end of the container 12 and a proximal end surface 110 of the ram head 96. As shown, the ramrod 94 extends through the bias member opening and through a throughbore 112 of the proximal side support member 56. More specifically, the throughbore 112 extends through the thickness of the proximal side support member 56.

As shown in FIGS. 3, 3A, and 4, the trigger member 88 is preferably positioned at the proximal end of the container 12. More specifically, the trigger member 88 resides at the proximal end of the proximal support member 56. In an embodiment, at least a portion of the trigger member 88 resides within a channel 114 within the thickness of the proximal support member 56. The trigger member 88 is able to be rotated within the channel 114 of the proximal support member 56. In a preferred embodiment, the trigger member 88 comprises an "L" shaped bar 116 having a first bar portion 118 spaced from a second bar portion 120. The first and second bar portions 118, 120 are oriented about perpendicular to each other. In a preferred embodiment, the first portion 118 of the trigger member 88 comprises a flat portion 122 that resides within the exterior surface of the first portion 118 of the bar 116. More preferably, the flat portion 122 is a recess within the thickness of the first end portion 118 of the bar 116, having a flat portion surface that is planar. The end of the second portion 120 of the bar 116 may comprise an annular groove 126 within which a clip 128 of the connection rod 90 may be positioned. Preferably, the bar 116 has a curved cross-section, however, the bar 116 may comprise across-section of a multitude of shapes including, but not limited to a rectangle, an oval, a hexagon, a triangle and the like. In addition, the bar 116 may be comprised of metallic, ceramic or polymeric material.

As shown in FIGS. 6 and 6A, the first portion 118 of the bar 116 is positioned within the notch 102 opening of the proximal end portion 108 of the ramrod 94. More specifically, the first portion 118 of the bar 116 is positioned such that the flat portion 122 of the first portion 118 of the bar 116 is facing away from the ramrod 96 and towards an interior surface 130 within the channel 114 of the proximal end support member 56. Opposite the flat portion 122 of the first portion 118 of the "L" shaped bar 116 is positioned a curved side of the first portion 118 facing the ramrod notch 102. This allows the trigger member 88 to rotate about a perpendicular axis with respect to the longitudinally positioned ramrod 94.

As shown in FIGS. 6 and 6A, the connection rod 90 is positioned along the length of the container 12, about parallel to longitudinal axis A-A. The connection rod 90 may be positioned alongside the base support member 52 or alternatively may reside within an opening within the thickness of the base support member 52. In a preferred embodiment, the connection rod 90 comprises a first connection end 132 spaced from a second connection rod end 134, an elongated connection rod length 136 positioned therebetween. Preferably, the connection rod 90 has a curved cross-section, however, the connection rod 90 may comprise across-section of a multitude of shapes including, but not limited to a rectangle, an oval, a hexagon, a triangle and the like.

In a preferred embodiment, the connection rod 90 may comprise a flexible wire or cable. The connection rod 90 may be comprised of metallic, ceramic or polymeric material. In a preferred embodiment, the connection rod 90 may comprise a bulbous end 138 at the end of the first portion 132 and the connection rod clip 128 at the end of the second portion 134. The bulbous connection rod end 138 is designed to be attached to the fuse member 92 and the clip 128 is attached to the end of the second portion 120 of the trigger member 88.

In a preferred embodiment, the fuse member 92 is positioned at the end of the first portion 132 of the connection rod 90. More specifically, the fuse member 92 is physically connected to the first end 132 of the connection rod 90. As illustrated in FIGS. 3, 3A, 4, and 6, the fuse member 92 may comprise a fuse body 142 that is cylindrical. Alternatively, the fuse body 142 may be of a round, oval, or bulbous shape. In either case, it is preferred that the fuse member 92 be positioned within a fuse member opening 144 within the bottom of the base support member 52. In a preferred embodiment, the positioning of the fuse member 92 within the fuse member opening 144 of the base support member 52 provides tension on the connection rod 90 and second portion of the trigger member 88.

When attached to the end of the connection rod 90, in a non-activated state, the fuse member 92 prohibits movement of the connection rod 90, which thus prohibits movement of the trigger member 88, thereby preventing movement of the ram 84 against the fire suppressant composition 14. In a preferred embodiment, the fuse member 92 is composed of a glass or metallic material having a liquid core. The fuse member or thermally responsive element 92 is designed to blow and break away from the end of the connection rod at a specific temperature ranging from about 150° F. to about 500° F. The fuse member or thermally responsive element 92 is designed to meet or exceed the National Fire Protection Association's (NFPA), the American National Standards Institute's (ANSI), and Underwriters Laboratories' (UL) standards on quartz quick response glass bulb fuses. The fuse member 92 of the system 10 of the present invention is further constructed to have an Underwriters Laboratories (UL) life span of fifty years before requiring replacement.

Figure 8:
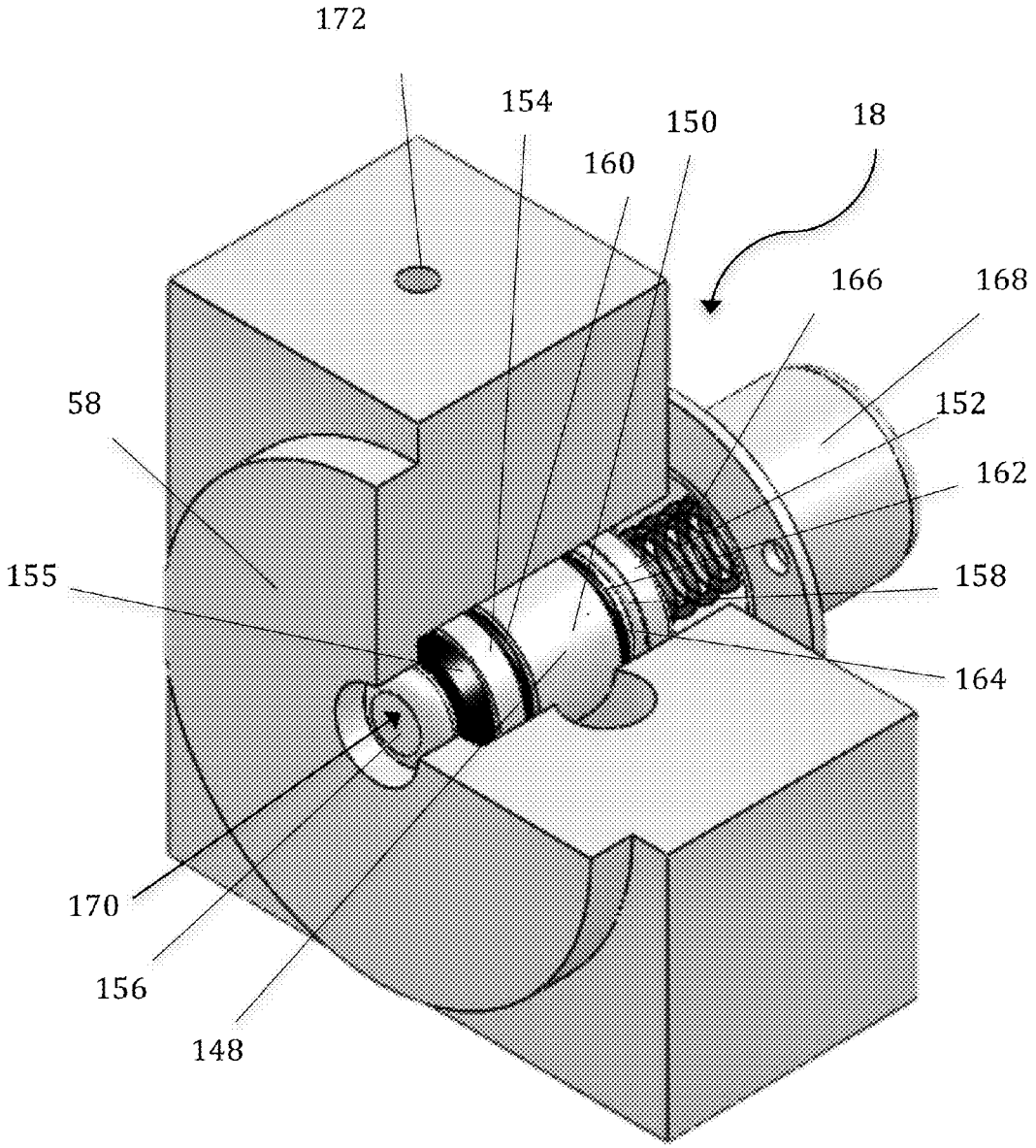
FIG. 8 illustrates an isolated partly cut away perspective view of the valve mechanism.

As shown in FIGS. 7 and 8, the valve mechanism 18 is preferably positioned at the opposite distal end portion 34 of the container 12. As shown, the valve mechanism 18 preferably resides within, and extends longitudinally, through a distal end support through bore 146 of the distal support member 58. In a preferred embodiment, the valve mechanism 18 comprises a valve cylinder body 148 having an annular valve cylinder sidewall 150 extending between a valve cylinder distal end 152 and a valve cylinder proximal end 154.

As shown, a valve button portion 156 resides at the proximal end of the valve cylinder 148. A valve gasket 155 resides distal of the valve button portion 156. A first valve O-ring 160, positioned within a first annular valve groove 162, may be positioned circumferentially around the valve cylinder 148 distal of the valve button portion 156 and the valve gasket 155. A second valve O-ring 162 may be positioned within a second annular valve groove 164. The first and second valve O-rings 160, 162 as well as the valve gasket 155 are designed to prevent undesired leakage of the fire suppressant composition 14 prior to activation of the system 10. Furthermore, a valve expansion ring 158 may be positioned circumferentially around the valve cylinder 148 distal of the second valve O-ring 162.

As shown in FIG. 8, a valve bias member 166 is positioned distal of the valve cylinder 148 and distal of the sidewall of the distal support member 58. The valve bias member 166 provides a counter bias force against the valve cylinder 148 in the proximal direction. The valve bias member 166 is designed such that the bias member 166 provides a force against the valve cylinder 148 in the proximal direction such that the cylinder 148 remains within the distal end support throughbore 146 of the distal support member 58 prior to activation of the system 10. A valve end cap 168 is preferably positioned over the valve bias member 166 such that an interior surface of the valve end cap 168 acts as a backstop for the valve bias member 166. The valve end cap 168 is mounted to the end sidewall of the distal support member 58.

Furthermore, prior to activation of the system 10, the ramrod 94, under pressure from the spring 86, presses against the flat side 122 of the first bar portion 118 of the trigger member 88. However, the connection rod 90 prevents the trigger 88 from turning, which would allow ram 84 to move past the flat side 122 and the first bar portion 118 of the trigger member 88. Furthermore, the fuse member 92 and the connection rod 90 provide tension to the trigger member 88.

When the system 10 is activated, the fire suppressant composition 14 pushes against an exterior surface 170 of the button portion 156 of the valve mechanism 18, pushing the cylinder valve body 148 distally through the distal support member throughbore 146. The valve cylinder 148 moves past a distal support member tunnel 172 within the distal support member 58 thereby providing an opening or pathway through which the fire suppressant composition 14 flows. In a preferred embodiment, once the expansion ring 158 reaches past the end of the sidewall of the distal support end 58, the expansion ring 158 expands outwardly, thus preventing distal or reverse movement of the valve cylinder body 148. Thus, the expansion ring 158 prevents the valve cylinder 148 from moving backwards and impeding the flow of the fire suppressant composition 14 through the tunnel 172 of the distal support member 58.

When a fire heats the fuse member 92 to a predetermined temperature, it breaks, thereby relieving the tension on the connection rod 90. Thus when tension on the connection rod 90 is relieved, the trigger member 88 rotates thereby allowing the ram head 96 to move and push the fire suppressant composition 14 within the container 12 in a distal direction. Movement of the fire suppressant composition 14, within the container 12, forces the material 14 against the button portion 156 of the valve mechanism 18. Continued distal movement of the fire suppression composition 14, further moves the valve cylinder 148 in a distal direction past the distal support member tunnel 172 thereby providing an opening through which the fire suppressant composition 14 is released. More specifically, when the fuse member 88 breaks, the first portion 118 of the trigger member 88 rotates within the channel 114 of the proximal support member 56 due to pressure from the ramrod 94 against the flat side 122 of the first bar portion 118 of the trigger member 88. After the tension from the fuse member 92 is released, the ram 84 is then propelled by the force provided by the bias member 86, past the flat side 122 of the first bar portion 118 of the trigger member 88 within the container 12.

Distal movement of the ramrod 94 past the flat portion 122 of the first portion 118 rotates the trigger member 88 within the channel 114 of the proximal support member 56. This rotation of the trigger member 88 causes the rotation of the second bar portion 120 of the trigger member 88 in an outwardly clockwise or counter clockwise direction from the end sidewall of the proximal end support member 56. Alternatively, the second bar portion 120 of the trigger member 88 could rotate clockwise or counter clockwise under the base support member 54. In doing so, the second bar portion 120 of the trigger member 88 may strike and thereby activate a micro-switch 174.

Figure 13:
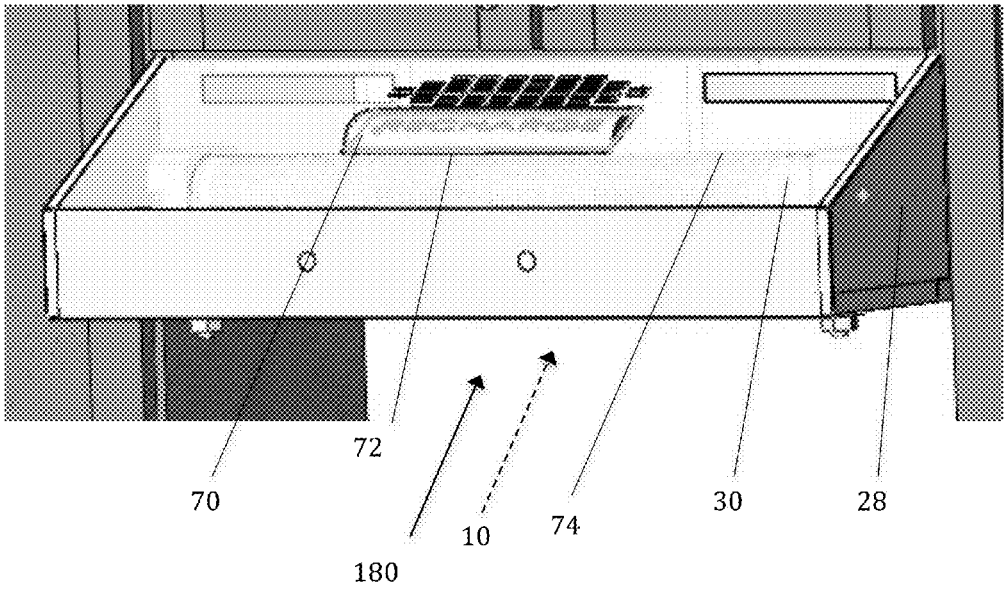
FIG. 13 illustrates an embodiment of the fire suppression system after it has been activated.

As shown in FIGS. 3 and 3A, the micro-switch 174 may activate a shut-off box 176 of the stove 22 (FIG. 1) and may set off an alarm 178 or other alert signal. Alternatively, the second bar portion 120 of the trigger member 88 could pull a cable or wire (not shown) or strike a cable trigger thereby activating the shut-off box 176, shutting off the stove 22 (FIG. 1) and setting off the alarm 178 or other alert signal. Furthermore, as shown in FIG. 13, a manual override activation switch 179 may be provided and activated by a user 181. When switched, the manual override activation switch 179 activates the fire suppression system 10 and may also activate the shut-off box 176. A more detailed description of an embodiment of a mechanical shutoff mechanism of the fire suppression system 10 is disclosed in U.S. Pat. Nos. 7,303,024 and 5,992,531, both to Mikulec, which are incorporated herein by reference.

Although a mechanical stove shut off mechanism 176 is preferred, a pneumatic or electrical stove shut off mechanism 176 may also be used with the system 10. Furthermore, the stove shutoff mechanism 176 may be designed to shut off an electric and/or gas powered stove 22. Examples of such over shutoff mechanisms are disclosed in U.S. Pat. Nos. 4,813,487 and 4,979,572, both to Mikulec et al., the disclosures of which are incorporated herein by reference.

As shown in FIGS. 3, 3A, 4-5, and 6, the fuse member 92, trigger member 88, connection rod 90, nozzle 50 and other associated system components maybe positioned beneath or in front of the container 12. More specifically these components may be positioned over the burner(s) 24 of the stove 22. In a preferred embodiment, the fuse member 92 is positioned over an optimal heat transfer zone 180 of the stove 22. The optimal heat transfer zone 180 is an area over the stove 22, which typically receives the most heat given off from the burners 24 of the stove 22 below. In other words, the optimal heat transfer zone 180 is an area over the stove 22, which generally is the hottest above the stove 22. The optimal heat transfer zone 180 is generally the area within which heat given off by the burners 22 converges together. The optimal heat transfer zone 180 is typically offset from the center of the stove 22, specifically about midway between the left and right side of the stove 22 and about between the front side and center of the stove 22.

In addition, the fuse member 92, connection rod 90, nozzle 50 and other associated components of the system 10, may be concealed within the base support member 52. As previously mentioned, the proximal and distal support members 56, 58, are positioned at the respective proximal and distal ends 36, 38 of the container 12. These proximal and distal support members 56, 58 are designed not only to provide mechanical support to the respective distal and proximal ends of the container 12 but also to conceal the components of the system 10 that extend from these ends. In a further embodiment, a fire suppressant tunnel or passageway 182 may be formed within the base, distal, and proximal support members 52, 58 and 56 to provide an opening through which the fire suppressant composition 14 flows from the container 12 to the nozzle(s) 50. This fire suppressant passageway 182 may be dimensioned such that it provides a leak tight ingress through which the fire suppressing composition moves through when the system 10 is activated.

As shown in FIGS. 4 and 5, the light source 16 is mounted adjacent to the container 12 and configured to emit light onto the exterior of the sidewall 38 of the container 12. In a preferred embodiment, the light emitted from the light source 16 is emitted through the container 12 and through the light transparent window 70 positioned within the intermediate panel portion 66 of the housing 60.

Alternatively, as previously mentioned, and shown in FIGS. 3 and 3A, the system 10 may be designed without the use of the housing panels 62, 64 and 66. The light source 16 is positioned adjacent the container 12 and may reside on a top surface of the base support member 52. An embodiment of the system 10 lacking the housing panels 62, 64, 66 is ideally suited for use in small-dimensioned ventilation hoods 28 or within other small spaces. Such is typically the case when installing the system 10 below a microwave oven 186 or positioned directly above a stove 22 within in an enclave 185.

Figure 9:
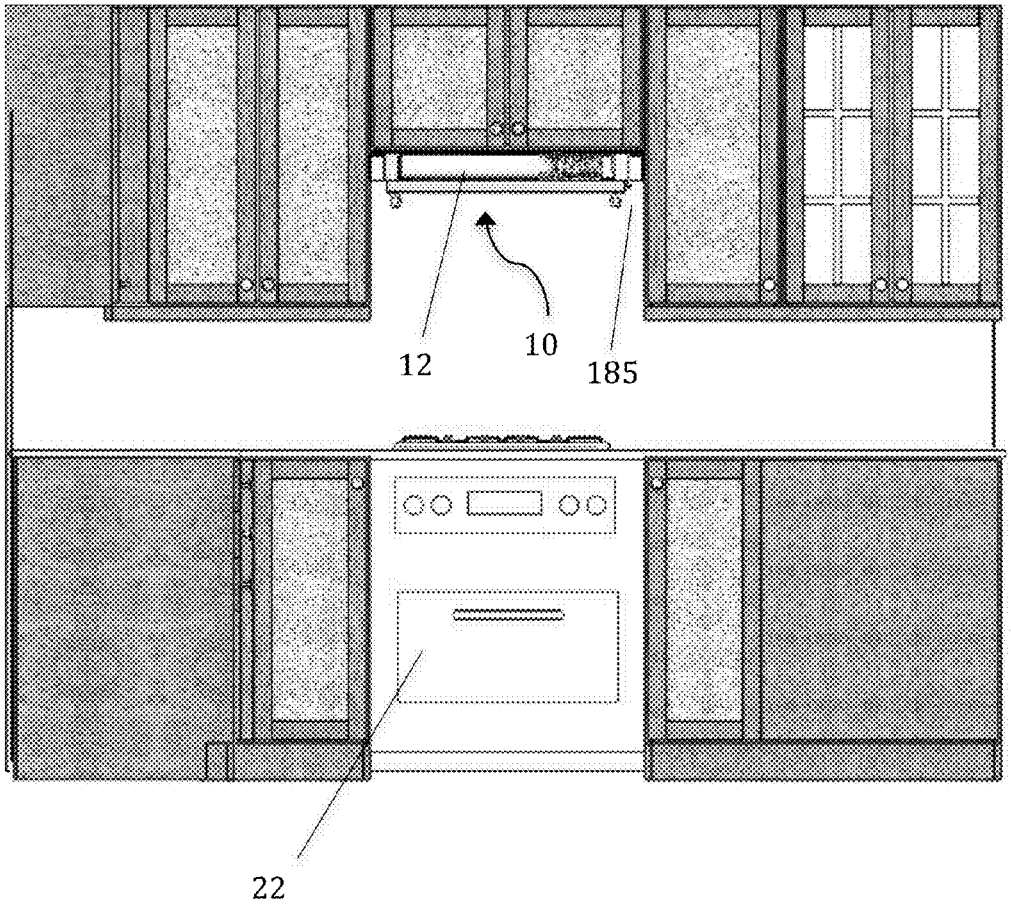
FIG. 9 shows an alternate embodiment of the fire suppression system of the present invention positioned within an enclave above a stove.
Figure 10:
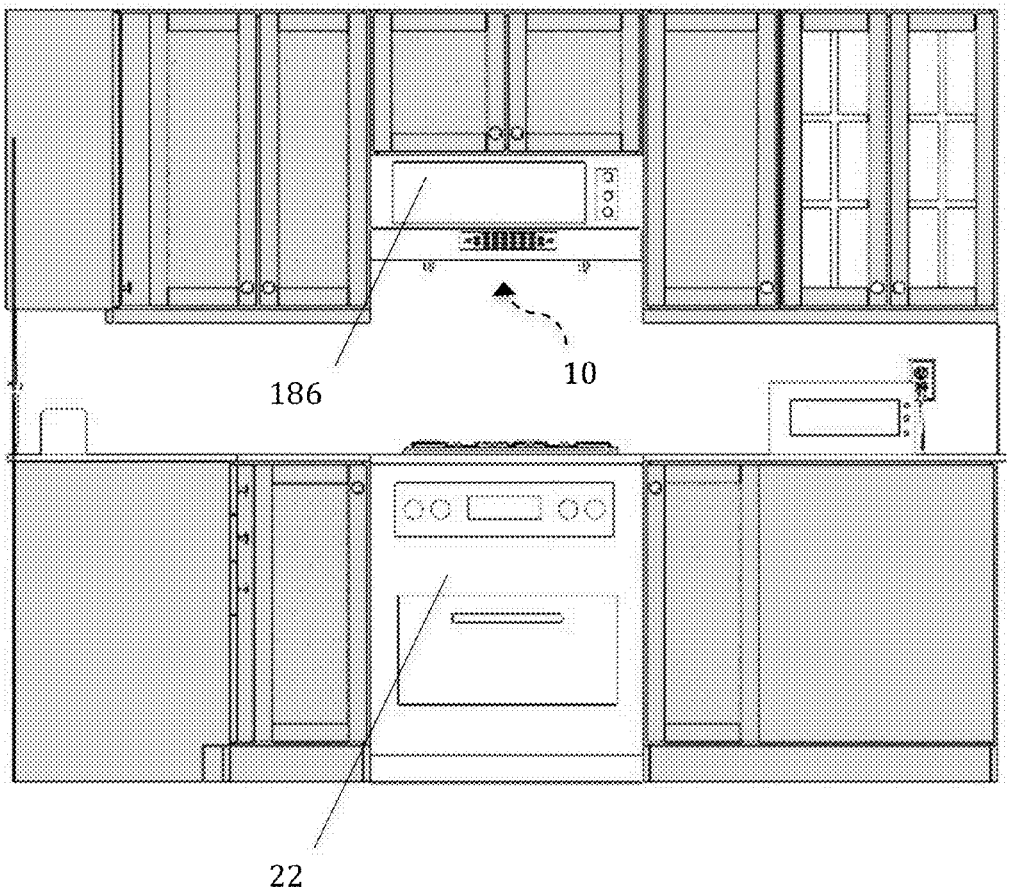
FIG. 10 shows a perspective view of an alternate embodiment of the fire suppression system of the present invention positioned under a microwave and further positioned over a stove.
Figure 11:
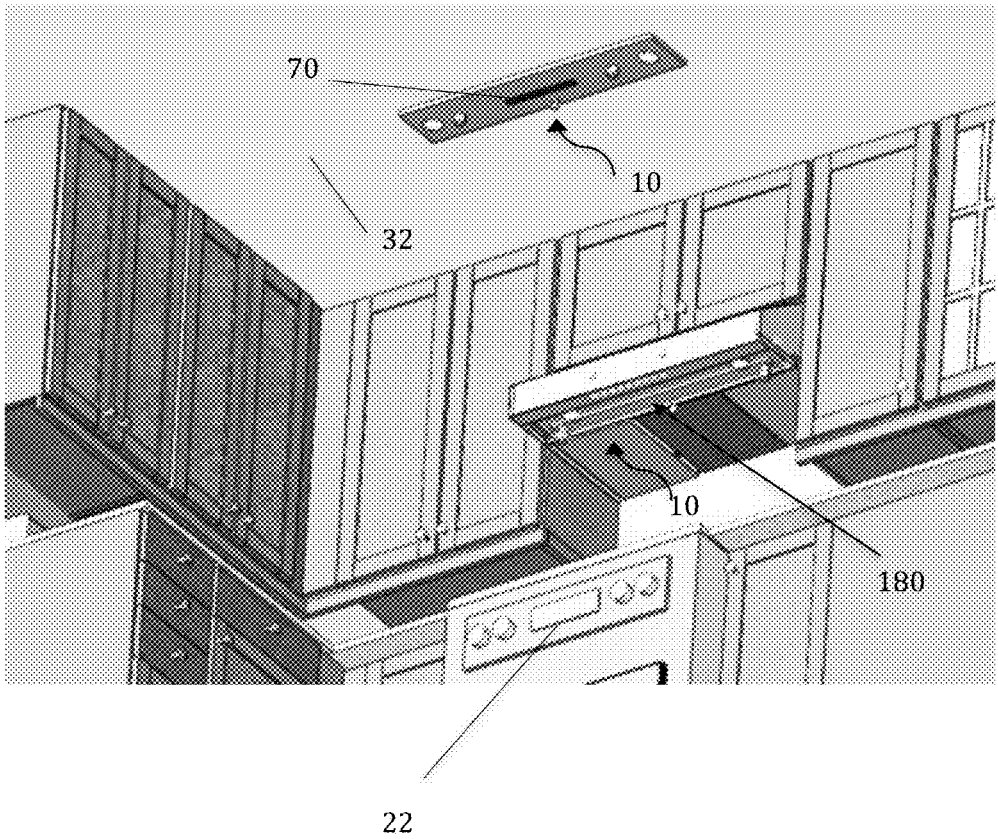
FIG. 11 illustrates a perspective view of alternate embodiments in which the fire suppression system of the present invention is positioned within a ceiling and/or within a ventilation hood over a stove.
Figure 12:
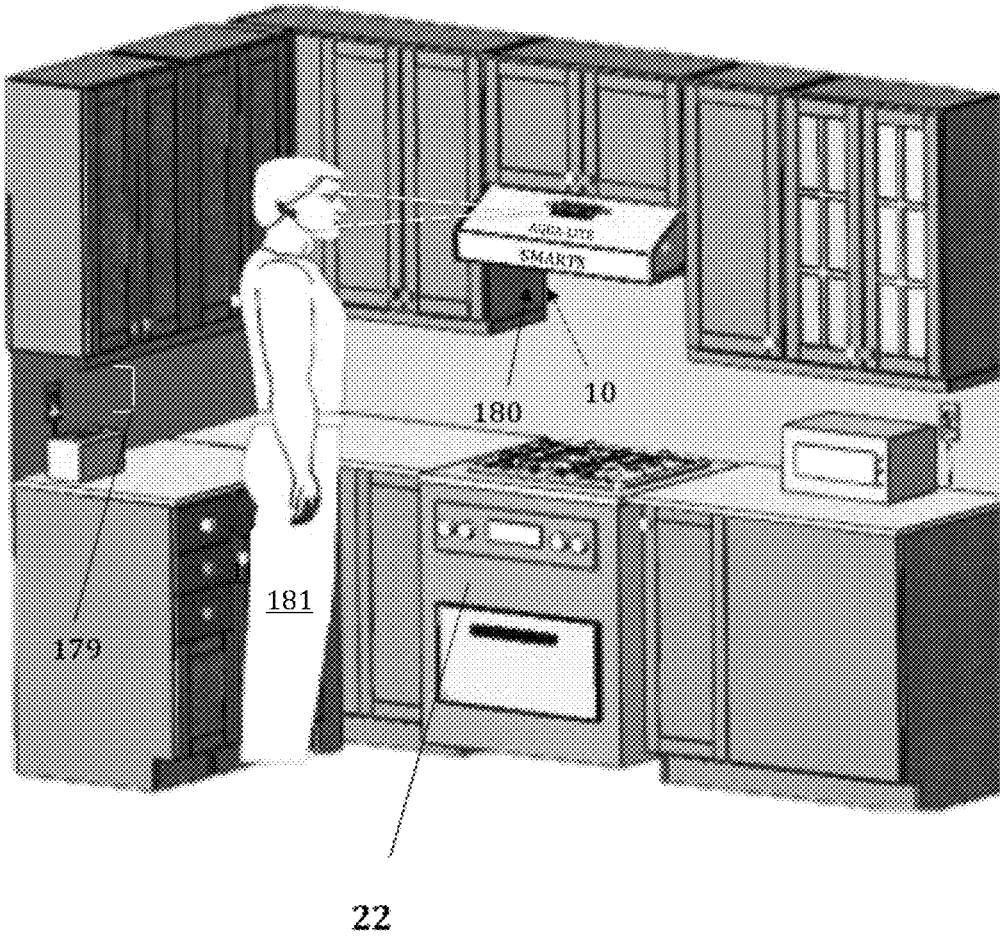
FIG. 12 shows an embodiment of a user viewing the fire suppression system of the present invention.

FIGS. 9 and 10 illustrates these alternate embodiments of the fire suppression system 10 positioned within the space below a microwave oven 186 and within an enclave 185 above a stove 22. In these embodiments, conservation of space is of particular interest. As shown in these alternative embodiments, the system 10 is typically installed without the topside, intermediate or front side housing panels 62, 66, 64 of the housing 60. The omission of these panels enables the system 10 to be positioned in smaller spaces.

In a preferred embodiment, the light source 16 compromises a plurality of light emitting diodes (LEDs) 188. As shown in FIGS. 3, 3A and 4, the light source 16 is mounted on the topside surface 184 of the base support member 52. In a preferred embodiment shown in FIGS. 3 and 4, the light source 16 is in the form of an LED bank 190. As shown, a plurality of LED lights is positioned in back of the container 12. These LEDS may be controlled with a light controller 192 such as a microcontroller or microprocessor (FIG. 1). The LEDs may be super luminescent light emitting diodes (SLED) emitting high intensity broad spectrum white light, or they may emit colored visible light. In an embodiment, these LED light are designed to be able to emit light for at least twelve years. Other suitable light sources such as an incandescent light bulb, a halogen lamp, a xenon lamp, or combinations thereof may also be used. In a preferred embodiment the light controller 192 may be used to control the specific sequence of lights that are on and off. For example, the light controller 192 may be electrically connected with a microcontroller (not shown) to indicate a possible malfunction of the system 10. Lights of differing colors and/or intensities may be turned on and off to indicate operating conditions. In addition, the light controller 192 may be used to selectively turn on a different bank of lights at differing time intervals, for example, every three years, to conserve the service life of the lights and minimize need to for light replacement.

Alternatively, as shown in FIG. 3A, the light source 16 may comprise a single light source 16 that spans the length the container 12. Furthermore, the light source 16 may be positioned at a remote location from the container 12 with the light being directed to the sidewall 38 of the container 12. For example, a mirror or series of mirrors (not shown), fiber optic cable (not shown) or other suitable means may be used to focus light to the sidewall 38 of the container 12.

The fire suppressant composition 14 preferably comprises a colorant therewithin. The colorant within the fire suppressant composition 14 is designed such that when visible light is directed through the transparent portion of the sidewall 38 of the right-side 44 of the container 12 and through the fire suppressant composition 14, the light interacts therewithin such that the color of the visible light changes from a first appearance to a second appearance. Therefore, when the visible light exists the opposite left side 42 of the container 12, the visible light is of the second appearance, which is different than the first appearance. More specifically, the first and second appearances may be of different colors. For example, the visible light entering the container 12 may be of a white color appearance and the visible light exiting the container 12 may be of a blue, red, green, brown, grey, black or combination thereof, or other color appearance that is different than the first appearance of the light. Furthermore, the appearance of the light emitted through the container containing the fire suppressant composition 14 and colorant may affect the light such that its intensity is modified. For example, the second appearance of the light may have an intensity that is more or less than the light of the first appearance. In an embodiment, the colorant in the fire suppressant composition 14 may absorb the light such that no visible light is emitted from the container 12.

In certain embodiments, the colorant of the fire suppressant composition 14 may be a dye. In one embodiment, the dye may be a blue dye, such that when visible white light is directed onto the right side of a first light translucent portion 194 of the sidewall 38 of the container 12, the visible light passes through the fire suppressant composition 14 through the opposite second light translucent portion 196 on the left side of the container 12. The light may continue to pass through the light translucent window 70 positioned within the panel 62, 64, 66 of the ventilation hood 28. Alternatively, the light may be directed through the container 12 comprising the light translucent material, as previously described.

For example, when the fire suppressant composition 14 is present in the container 12, a person 181 (FIG. 12) sees the light, the appearance of which having been modified to the second appearance by the presence of the colorant in the fire suppressant composition 14 such as blue, emanating through the window 70. When at least some of the fire suppressant composition 14 has been depleted from the container 12, the person 181 (FIG. 12) may see a fainter light, such as blue light, and/or higher intensity light since less light is being absorbed by the remaining fire suppressant composition 14 in the container 12 is easily detectable by the person. When the system 10 has been activated and the fire suppressant composition 14 has been expelled from the container 12, a person 181 sees the light of the first appearance, such as white, emanating from the light source 16 through the container 12. Since the fire suppressant composition 14 comprising the colorant is no longer in the container 12, the light emanating from the light source 16 adjacent to the container 12 is no longer being modified. In addition, the person 181 may also see portions of the bias member 86 and/or the ram 84 through the window 70 within the container 12.

Furthermore, as shown in FIG. 13, when the system 10 has been activated, the word "recharge" may also appear in the window 70 notifying the user that the system was activated and thus requires recharging or replacement. In addition a reflective coating or magnifying lens may be applied to the window 70 to improve illumination of the window 70 showing the word "recharge". In any case, the partial or complete discharge of the composition 14 from the container 12 is easily detectable by a person 181.

The light source 16 may be connected to a backup energy source such as a generator (not shown) or electrochemical cell (not shown) in the event of a power failure. If no power is provided to the light source 16, a person can still detect the status of the system by looking at the window 70 from a closer vantage point. The color of the composition 14 will be visible through the transparent sidewall 38 or window 70 of the container 12. If the container 12 has been emptied, any internal components within the container 12, such as the ram 84 or bias member 86, will also be visible.

In an embodiment, the light transparent window 70 may be provided with a surface coating or with embedded particles to scatter the transmitted light, thereby making it more visible to a person regardless of their location within the room. Alternatively or additionally, the window 70 may be formed as a lens configured to direct light preferentially toward a desired location most likely occupied by a person. Alternatively, if the system 10 is constructed without the housing 60, a person through direct viewing of the container 12 can easily determine the status of the system 10. If the light emanating from the container 12 is of the second appearance, then the system 10 has not been activated, however if the light emanating from the container 12 is of the first appearance, then the system 10 has been activated.

The fire suppressant composition 14 may contain other colorants, such as other colored dyes. It is not required that the composition 14 contain a dedicated colorant. The composition 14 may inherently have light absorbing characteristics that render that render it suitable for use as described herein. In a preferred embodiment, the composition may contain a mixture of potassium carbonate, a boron-containing compound, and water. More specifically, the composition may comprise water, potassium carbonate and the boron-containing compound, the potassium carbonate is present in an amount of between about 20% and 40% by weight, more preferably between about 25% and 26% by weight and most preferably between about 30% and 42% by weight such as that described in U.S. Pat. No. 4,756,839 to Curzon et al., the disclosure of which is incorporated herein by reference. A suitable fire suppressant composition 14 is Aqua-Lite™, manufactured by the SmartX® Corporation of Orchard Park, N.Y. In addition, the fire suppressant composition 14 may comprise a haloalkane or halogenoalkane based material that typically contains alkanes with linked halogens. Furthermore, the fire suppressant composition 14 may comprise chlorofluorocarbon, sodium bicarbonate, potassium bicarbonate or lithium bicarbonate. The fire suppressant composition 14 may further comprise a polymeric surfactant. Such compositions 14 may include a water-soluble dye, such as a blue or greenish-blue or aqua color dye ("Aqua-Lite"). Various non-toxic water-soluble blue or aqua color dyes are known, such as those used in ponds and water tracing applications.

In an alternate embodiment, the fire suppression system 10 of the present invention may be provided as a modular unit. In this alternative embodiment, the container 12 and light source 16 may be positioned within the housing 60 that encompasses these components therewithin. The modular unit may therefore be positioned within the canopy portion 30 of the ventilation hood 28 of the stove 22. This modular unit design provides a quick and easy means of installation within an existing stove ventilation hood 28 that has already been installed for service. The modular unit design minimizes preparation of the canopy 30 of the ventilation hood 28. In a preferred embodiment, the modular unit could be directly positioned within the canopy portion 30 utilizing fasteners.

As illustrated in the embodiment of FIG. 1, the fire suppression system 10 of the present invention may comprise an alarm 178. The alarm 178 may be of an audible or visual alarm such as that of an indicator light. The alarm 178 may be electrically connected to the micro-switch 174 such that in the event that the system 10 is activated, an audible alarm sound is emitted or visible alarm indictor is shown. Such an alarm signal may be connected to a burglar alarm system (not shown).

In addition, the system 10 may be designed such that when a fire is detected and the system 10 is activated, a signal is sent to a remote location such as a central control room, a fire station, a police station, or other first response station. This signal may be sent through a dedicated hard wire line, a telephone landline, or via a wireless mobile phone. It is further contemplated that such a signal may be transmitted via a wireless signal 197 through a wireless transmitter 198. A corresponding wireless receiver 200 may be provided with the system 10. As shown in FIG. 1, the wireless receiver 200 may be positioned adjacent the stove 22. In a further embodiment, the wireless transmitter 198 and wireless receiver 200 may be used to send a wireless signal 197 to activate the shutoff mechanism 176 for the gas and/or electricity powering a stove 22.

In a further embodiment of the present invention, a signal to actuate the shutoff mechanism 176 may be provided by a device that utilizes the X10 communication protocol, such as the SmartX10 device manufactured by the SmartX Corporation of Orchard Park, N.Y. The X10 communication protocol utilizes the power line and internal electrical wiring within a dwelling to transmit an X10 signal. Furthermore, the X10 signal may be a coded or encrypted signal. In a preferred embodiment, a transmitting X10 device may be utilized to transmit the X10 signal through the wiring of the dwelling that activates the shutoff mechanism 176. A corresponding X10 receiving device may be used to receive the X10 signal. In addition, the X10 communication protocol may utilize the wireless transmitter 198 and/or the wireless receiver 200 in transmitting the X10 signal and/or the wireless signal 197.

As illustrated in FIG. 1, the system 10 may also comprise a motion sensor 202. The motion sensor 202 may be designed such that when the stove 22 or oven 26 is on for a prescribed amount of time and no motion has been detected, the system 10 may be activated. In addition, a video camera 204 and/or microphone 206 may also be connected within the system 10. The image and audio from the video camera 204 and/or the microphone 206 may also be used to detect motion next to the stove 22 and thereby cause the system 10 to be activated.

In addition, the fire suppression system 10 may comprise a temperature sensor 208 that is electrically connected to a microcontroller or microprocessor. In the event that a temperature is detected, for example, that exceeds a predetermined temperature, for example, 200° F., the microcontroller or microprocessor may activate the system 10 and shutoff mechanism 176. Furthermore, the microcontroller may send an alert signal to the first responder station.

In a preferred embodiment, the temperature sensor 208 may work in conjunction with input from the video camera 204 and/or the microphone 206 and/or the motion sensor 202. More specifically, information from the various input signals from the temperature sensor 208, the video camera 204 and/or the microphone 206 and/or the motion sensor 202 can be analyzed by the microcontroller or microprocessor to determine if there is a possible emanate danger of a fire thereby requiring activation of the fire suppression system 10 and/or the alarm 178. For example, if motion or sound has not been detected for approximately 5 to 60 minutes, and the temperature above the stove 22 is increasing to a cautionary temperature range of between about 100° F. to about 150° F., then the alarm 178 may be activated. If the temperature continues to rise into a critical temperature range above 150° F., then the fire suppression 10 may be activated to preemptively prevent a fire from occurring.

The attached drawings represent, by way of example, different embodiments of the subject of the invention. Multiple variations and modifications are possible in the embodiments of the invention described here. Although certain illustrative embodiments of the invention have been shown and described here, a wide range of modifications, changes, and substitutions is contemplated in the foregoing disclosure. In some instances, some features of the present invention may be employed without a corresponding use of the other features. Accordingly, it is appropriate that the foregoing description be construed broadly and understood as being given by way of illustration and example only, the spirit and scope of the invention being limited only by the appended claims.

What is claimed is:

1. A fire suppression system, comprising:

a) a container, having an annular sidewall extending from a container proximal portion to a container distal portion, at least a portion of the annular sidewall translucent to visible light;

b) a fire suppressant composition comprising a colorant residing within the container;

c) an actuator sub-assembly capable of expelling the fire suppressant composition out the container distal end portion, at least a portion of the actuator sub-assembly positioned within the container proximal portion;

d) a valve mechanism having a valve body positioned at a container distal end;

e) a light source positioned adjacent the container such that visible light emanating from the light source is transmittable through a first container sidewall, through the fire suppressant composition and through a second container sidewall;

f) wherein actuation of the actuator sub-assembly causes the fire suppressant composition to move the valve body in a distal direction thereby allowing the fire suppressant composition to expel out the container; and g) wherein prior to expulsion of the fire suppressant composition from the container, visible light transmitted through the container is of a first appearance and when the fire suppressant composition has been expelled from the container, visible light transmitted through the container is of a second appearance.

2. The system of claim 1 wherein the fire suppression system is positionable within a ventilation hood canopy, the ventilation hood canopy comprising a ventilation hood canopy sidewall.

3. The system of claim 2 wherein a light translucent opening resides within a portion of the ventilation hood canopy sidewall.

4. The system of claim 1 wherein a housing portion is positionable adjacent the container, a light translucent opening residing within a thickness of at least one sidewall of the housing.

5. The system of claim 4 wherein the housing comprises a front side panel portion, a top panel portion, and an intermediate panel portion.

6. The system of claim 1 wherein the colorant is of a visible color selected from the group consisting of blue, green, red, yellow, brown, grey, black, and combinations thereof.

7. The system of claim 1 wherein the fire suppressant composition comprises a mixture of potassium carbonate, a boron-containing compound, and water.

8. The system of claim 1 wherein the fire suppressant composition comprises haloalkane, halogenoalkane, chlorofluorocarbon, sodium bicarbonate, potassium bicarbonate, lithium bicarbonate, a surfactant or combinations thereof.

9. The system of claim 1 wherein the light source comprises at least one light emitting diode, a super luminescent light emitting diode, an incandescent light bulb, a halogen lamp, a xenon lamp, or combinations thereof.

10. The system of claim 9 wherein the light source has a rated usable life of at least 12 years.

11. The system of claim 1 wherein the light source is controlled by a light source controller unit.

12. The system of claim 1 wherein the container is comprised of a visible light transmittable material.

13. The system of claim 1 wherein the container is composed of a glass or a polymeric material.

14. The system of claim 1 wherein the container comprises a silicate glass, a borosilicate glass, polypropylene, silicone rubber, polycarbonate, polymethyl methacrylate, graphene or combinations thereof.

15. The system of claim 1 wherein at a least a portion of a container sidewall is translucent to visible light.

16. The system of claim 1 wherein the actuator sub-assembly comprises a ram, a trigger member, and a connection rod.

17. The system of claim 1 wherein the valve mechanism further comprises a valve expansion ring positioned circumferentially around the valve body, a valve end cap positioned adjacent a valve body distal end and a valve bias member positioned adjacent the valve distal end within the valve end cap.

18. The system of claim 17 wherein actuation of the actuator sub-assembly causes the valve mechanism expansion ring to expand in an outwardly direction such that the valve body is not capable of movement in a proximal direction.

19. The system of claim 1 wherein the fire suppressant composition resides within the container under a standard state condition.

20. The system of claim 1 wherein actuation of the actuator sub-assembly causes a hydrostatic pressure of less than 45 PSI to be applied to the fire suppressant composition.

21. The system of claim 1 further comprising an oven shutoff mechanism, the oven shutoff mechanism activatable when a fire is detected.

22. The system of claim 21 wherein the oven shutoff mechanism is activatable using an X10 protocol signal.

23. The system of claim 21 wherein the oven shutoff mechanism is activatable through a mechanical, pneumatic or electrical means.

24. The system of claim 1 further comprises an alarm, the alarm activatable when a fire is detected.

25. The system of claim 24 wherein the alarm emits an audible or visual signal.

26. The system of claim 1 wherein when a fire is detected, an oven shutoff signal is emitted through a hard wire or wirelessly.

27. The system of claim 1 wherein the second appearance of the light through the container is of a white color.

28. The system of claim 1 further comprising a video camera, a microphone, a motion sensor, and a temperature sensor.

29. A fire suppression system, comprising:

a) a container, having an elongated annular sidewall extending along a longitudinal axis from a proximal portion to a distal portion, at least a portion of the annular sidewall translucent to visible light;

b) a fire suppressant composition comprising a colorant contained within the container distal portion;

c) an actuator sub-assembly comprising:

i) a ram positioned within the container proximal portion, the ram having a ramrod portion extending to a ramhead portion, the ramhead portion residing proximal of the fire suppressant composition and the ramrod portion extending proximally of the ramhead portion;

ii) a bias member, positioned proximal of the ramhead portion within the container, the bias member positioned circumferentially around the ramrod portion; and iii) a connection rod having a first end spaced from a second end, the first end connected to a fuse member and the second end connected to a trigger member;

d) a valve mechanism comprising:

i) a valve body having a valve body proximal end spaced from a valve body distal end, positioned along the longitudinal axis, the valve body proximal end positioned adjacent the container distal end;

ii) a valve expansion ring positioned circumferentially around the valve body;

iii) a valve end cap positioned adjacent the valve body distal end; and iv) a valve bias member positioned within the valve end cap adjacent the valve distal end;

e) a light source positionable adjacent the container such that light is transmittable through a first container sidewall, through the fire suppressant composition and through a second container sidewall; and f) wherein actuation of the actuator sub-assembly causes the fire suppressant composition to move the valve body in a distal direction thereby allowing the fire suppressant composition to expel out the container; and g) wherein prior to expulsion of the fire suppressant composition, light transmitted through the container is of a first appearance and when the fire suppressant composition has been expelled from the container, light transmitted through the container is of a second appearance.

30. The system of claim 29 wherein the fire suppression system is positionable within a ventilation hood canopy, the ventilation hood canopy comprising a ventilation hood canopy sidewall.

31. The system of claim 30 wherein a light translucent opening resides within a portion of the ventilation hood canopy sidewall.

32. The system of claim 29 wherein a housing portion is positionable adjacent the container, a light translucent opening residing within a thickness of at least one sidewall of the housing.

33. The system of claim 32 wherein the housing comprises a front side panel portion, a top panel portion, and an intermediate panel portion.

34. The system of claim 29 wherein the colorant is of a visible color selected from the group consisting of blue, green, red, yellow, brown, grey, black, and combinations thereof.

35. The system of claim 29 wherein the fire suppressant composition comprises a mixture of potassium carbonate, a boron-containing compound, and water.

36. The system of claim 29 wherein the light source comprises at least one light emitting diode, a super luminescent light emitting diode, an incandescent light bulb, a halogen lamp, a xenon lamp, or combinations thereof.

37. The system of claim 29 wherein the light source has a rated usable life of at least 12 years.

38. The system of claim 29 wherein at a least a portion of a container sidewall comprises a visible light translucent portion.

39. The system of claim 29 wherein the container is composed of a glass or a polymeric material.

40. The system of claim 29 wherein actuation of the actuator subassembly causes the fuse member to break, and thereby causing the ramrod portion to move in a distal direction past a flat portion of the trigger member.

41. The system of claim 29 wherein an oven shutoff mechanism is activatable by the actuator sub-assembly.

42. The system of claim 41 wherein the oven shutoff mechanism comprises a mechanical, pneumatic or electrical mechanism.

43. The system of claim 41 wherein actuation of the actuator sub-assembly causes a microswitch to have an oven shutoff signal be sent to the oven shutoff mechanism.

44. The system of claim 43 wherein the oven shutoff signal comprises an X10 protocol signal.

45. The system of claim 43 wherein the oven shutoff signal is sent through a hard wire, a wireless means or combinations thereof.

46. The system of claim 29 wherein an alarm is activatable by the actuator sub-assembly.

47. The system of claim 46 wherein the alarm emits an audible or visual signal.

48. The system of claim 29 wherein the second appearance is of a white color.

49. The system of claim 29 wherein the trigger member comprises a bar having a bar first portion spaced from a bar second portion.

50. The system of claim 29 further comprising a video camera, a microphone, a motion sensor, and a temperature sensor.

* * * * *